US008228192B2

(12) United States Patent
Eckert et al.

(10) Patent No.: US 8,228,192 B2
(45) Date of Patent: Jul. 24, 2012

(54) CABLE LOCK CLOSURE WITH DEFEAT PREVENTION

(75) Inventors: Lee Eckert, Waxhaw, NC (US); William J. Kozlowski, Jr., Tega Cay, SC (US); Matthew R. Shute, Charlotte, NC (US); Timothy M. Gates, Waxhaw, NC (US); James G. Wyatt, Jr., Weddington, NC (US); Stephen A. Orbach, Simi Valley, CA (US); Michael J. Cornelison, Elkins Park, PA (US)

(73) Assignee: Checkpoint Systems, Inc., Thorofare, NJ (US)

( * ) Notice: Subject to any disclaimer, the term of this patent is extended or adjusted under 35 U.S.C. 154(b) by 651 days.

(21) Appl. No.: 12/476,014

(22) Filed: Jun. 1, 2009

(65) Prior Publication Data

US 2009/0303046 A1 Dec. 10, 2009

Related U.S. Application Data

(60) Provisional application No. 61/057,604, filed on May 30, 2008.

(51) Int. Cl.
*G08B 13/12* (2006.01)
*E05B 65/00* (2006.01)

(52) U.S. Cl. ..... 340/568.2; 70/57; 340/568.4

(58) Field of Classification Search ..... 340/568.2–4, 340/542, 543, 652; 70/57.1, 49, 63, 58; 242/382
See application file for complete search history.

(56) References Cited

U.S. PATENT DOCUMENTS

| | | | | |
|---|---|---|---|---|
| 3,643,250 | A | 2/1972 | Sander | |
| 3,906,758 | A * | 9/1975 | Hurwitt | 70/30 |
| 4,086,795 | A * | 5/1978 | Foster et al. | 70/233 |
| 4,233,595 | A | 11/1980 | Landkammer | |

(Continued)

FOREIGN PATENT DOCUMENTS

WO 2005/118992 12/2005

(Continued)

OTHER PUBLICATIONS

International Search Report for corresponding PCT Application No. PCT/US2009/045853, dated Nov. 11, 2009.

*Primary Examiner* — Benjamin C Lee
*Assistant Examiner* — Sigmund Tang
(74) *Attorney, Agent, or Firm* — Sand & Sebolt

(57) ABSTRACT

A security device for attachment to an article to deter theft of the article has a housing containing an alarm system including an audible alarm with a defeat mechanism having a two-part connector that attaches to both a cable and a locking mechanism. The connector includes a mechanical fuse (e.g., two-step ferrule holder) that provides defeat prevention of the alarm device. The locked device alarms if pulled too hard from twisting the cable without releasing the primary lock. The connector is preferably shaped as a generally elliptic cylindrical bayonet having an oval transverse cross-section and a truncated oblique cone-shaped distal end. This enables the plug to be inserted into a locking channel of the locking mechanism in either of two directions facilitating the locking of the attached cable about an article of merchandise. Moreover, the oval shape takes up less space than a round bayonet while providing greater strength through longer latch engagement area on the wider side of the bayonet, especially as opposed to a circular cross-section bayonet.

13 Claims, 13 Drawing Sheets

U.S. PATENT DOCUMENTS

| | | | | |
|---|---|---|---|---|
| 4,930,324 | A * | 6/1990 | Meier | 70/18 |
| 5,144,821 | A * | 9/1992 | Ernesti et al. | 70/159 |
| 5,722,266 | A * | 3/1998 | Yeager et al. | 70/57 |
| 7,249,401 | B2 | 7/2007 | Copen et al. | |
| 7,259,674 | B2 | 8/2007 | Marsilio et al. | |
| 7,262,699 | B2 | 8/2007 | Marsilio et al. | |
| 8,122,744 | B2 * | 2/2012 | Conti et al. | 70/57.1 |
| 2005/0223756 | A1 * | 10/2005 | Ling et al. | 70/30 |
| 2007/0107477 | A1 | 5/2007 | Fawcett et al. | |
| 2007/0152835 | A1 | 7/2007 | Marsilio et al. | |
| 2007/0152836 | A1 | 7/2007 | Nagelski et al. | |
| 2008/0024300 | A1 | 1/2008 | Fawcett et al. | |
| 2008/0034815 | A1 | 2/2008 | Fawcett et al. | |
| 2008/0035778 | A1 | 2/2008 | Belden et al. | |

FOREIGN PATENT DOCUMENTS

| | | |
|---|---|---|
| WO | 2006/076348 | 7/2006 |
| WO | 2006076348 | 7/2006 |

* cited by examiner

CABLE LOCK CLOSURE WITH DEFEAT PREVENTION

CROSS-REFERENCE TO RELATED APPLICATIONS

This utility application claims the benefit under 35 U.S.C. §119(e) of Provisional Application Ser. No. 61/057,604 filed on May 30, 2008 entitled SELF-ALIGNMENT BAYONET CABLE-LOCK CLOSURE and whose entire disclosure is incorporated by reference herein.

BACKGROUND OF THE INVENTION

1. Field of Invention

The invention relates to theft deterrent devices, and particularly to an EAS tag carrying device that is secured to an item to deter theft thereof.

2. Description of Related Art

Various retail establishments use theft deterrent systems and devices to discourage shoplifting. Many of these theft deterrent devices use electronic article surveillance (EAS) tags attached to the item of merchandise. The tags are configured to activate an alarm of a security gate that is located at the exit of the retail establishment. Some more elaborate tags are also configured to activate an alarm at the tag itself if it is tampered with or if it approaches the security gate located at the exit of the retail establishment. Securing the EAS tag to merchandise is a problem faced by many retail establishments. The tags must be connected in a secure manner that prevents unauthorized removal while not damaging the items of merchandise. Also, the tags must be readily removable by authorized personnel so that the tags do not unduly delay checkout and inadvertently actuate the security gate alarm.

The prior art is replete with EAS tag carriers designed to secure the tags to merchandise. Various types are known in which frames extend around the items, pins pierce the items, and cables wrap around the items. The present invention relates primarily to the type of security devices that use cables to wrap around or through a portion of the merchandise, and also relates broadly to various alarming versions of cable locks, security storage containers or display packages with internal alarms, bottle security devices, ratchet strap locks, universal or cable wrap security devices and security display bags. Examples of these security devices are disclosed in U.S. Pat. Nos. 7,249,401; 7,259,674; and 7,262,699; and in U.S. patent application Ser. Nos. 11/607,671; 11/647,014; 11/320,092; 11/503,684 and 11/484,053, the disclosures of which are incorporated herein by reference in their entireties.

Many of these types of cable devices are large and bulky and require complicated mechanical mechanisms to lock and unlock the cable from the device for subsequent removal from the item of merchandise. Furthermore, the alarms contained in some of the prior art devices are actuated only if the cable is severed and/or broken away from the device, but will not sound the alarm during an attempt to break the cable from the device by excessive force. The inventors have recognized that a security device having the feature of sounding an alarm during an attempt to break the cable from the device would provide a benefit of alarming the vandalizing attempt before the locking device is compromised.

The inventors have discovered that excess twisting of cables locked in their security devices could short the cables against one another and thus keep the sense loop active so the tampered device would not alarm even if the locked cables are forcibly removed. The inventors have also discovered that the existing cable connectors are not automatically alignable with the locking mechanism of the alarm device. For example, known cable connectors are cylindrical, which allows for easy insertion but does not automatically align with the locking elements of the locking mechanism. As another example, other existing cable connectors are polygonal in transverse cross section, which allows for alignment with locking elements in the locking mechanism, but does not automatically allow for easy insertion and rotation to align with the locking elements.

The subject invention solves many of these problems by providing a device which is of a relatively inexpensive construction, yet is easily applied and removed from the protected item of merchandise, and which provides a versatile alarm system contained within the housing.

BRIEF SUMMARY OF THE INVENTION

Benefits of the preferred embodiments are obtained by a cable alarm security device of the present invention, an example of which may be stated as including a housing; a flexible cable having first and second ends, the first end being connected to the housing and the second end being connected to a two stage bayonet plug, wherein the plug is selectively connectable to and removable from the housing; a magnetically actuated locking mechanism mounted in the housing engageable with the plug and moveable between locked and unlocked positions to lock the plug to the housing; and an alarm system mounted within the housing and operatively connected to the cable to sound an audible alarm contained within the housing when the cable is moved from a conductively coupled locked position in the bayonet plug to a conductively disconnected retracted locked position in the bayonet plug. While not being limited to a particular theory, the bayonet is preferably an oval bayonet.

According to the preferred embodiments, the invention includes for example a security device for attachment to an article to deter theft of the article including a housing and a defeat mechanism. The housing contains an alarm system including an audible alarm. The defeat mechanism has a connector assembly that attaches to both an article holding member and the housing. The connector assembly includes a mechanical fuse that maintains the attachment to the article holding member and the housing while causing the alarm system to initiate an alarm when the article holding member is forced away from said housing to provide defeat prevention of the security device.

According to the preferred embodiments, the invention also includes for example a security device for attachment to an article to deter theft of the article including a housing, an alarm system with an alarm detection circuit, an article holding member and a defeat mechanism. The article holding member includes a conductive mechanical connector mechanically attached to the housing and conductively coupled to the alarm detection circuit to form a sense loop. The defeat mechanism has a connector assembly attached to both the article holding member and the housing. The connector assembly includes a mechanical fuse that maintains the mechanical attachment between the article holding member and the housing while causing the alarm detection circuit to initiate an alarm when the conductive mechanical connector opens the sense loop while being urged away from said housing to provide defeat prevention of the security device.

Further scope of applicability of the present invention will become apparent from the detailed description given hereinafter. However, it should be understood that the detailed description and specific examples, while indicating preferred embodiments of the invention, are given by way of illustration only, and that the invention is not limited to the precise arrangements and instrumentalities shown, since the invention will become apparent to those skilled in the art from this detailed description.

BRIEF DESCRIPTION OF SEVERAL VIEWS OF THE DRAWINGS

The following detailed description of preferred embodiments of the invention will be better understood when read in conjunction with the following drawings, in which like-referenced numerals designate like elements, and wherein.

DETAILED DESCRIPTION OF PREFERRED EMBODIMENTS OF THE INVENTION

An example of the preferred embodiments includes a defeat mechanism having a connector assembly that attaches to both the cable and the housing. In a preferred embodiment, for example, the connector assembly includes a two-step ferrule holder as a mechanical fuse that provides defeat prevention of the alarm device. While not being limited to a particular theory, the two-step ferrule holder may be attached to the housing, or may be part of a bayonet plug attachable to the housing to lock the security device. The locked device alarms if pulled too hard from twisting the cable without releasing the primary lock. Otherwise, excess twisting of the cables could short the cables against one another and keep the sense loop active so it would not alarm. When used with cable locks, the exemplary bayonet plug is oval transversely and elongated longitudinally. This enables the plug to be inserted into a locking channel of the locking mechanism in either of two directions facilitating the locking of the attached cable about an article of merchandise. Moreover, the oval shape takes up less space than a round bayonet. Thus the exemplary embodiments includes features providing: a) alternate alignment—the bayonet can be faced either of two ways, b) self-alignment—through chamfering of ingress point and rounding of the bayonet, c) greater strength through longer latch engagement area on the wider side of the bayonet, especially as opposed to a circular cross-section bayonet, d) dual locking positions combined with tamper detection of when a cable end (e.g., ferrule, connector) is forced out of a first position in a ferrule holder but before the second latch of the ferrule holder fails. Accordingly, the two-step ferrule holder is a mechanical fuse as a safety device defeat mechanism that interrupts a circuit to set off an alarm when it is defeated by force, while still maintaining the mechanical lock of an attached article.

Figure 1:
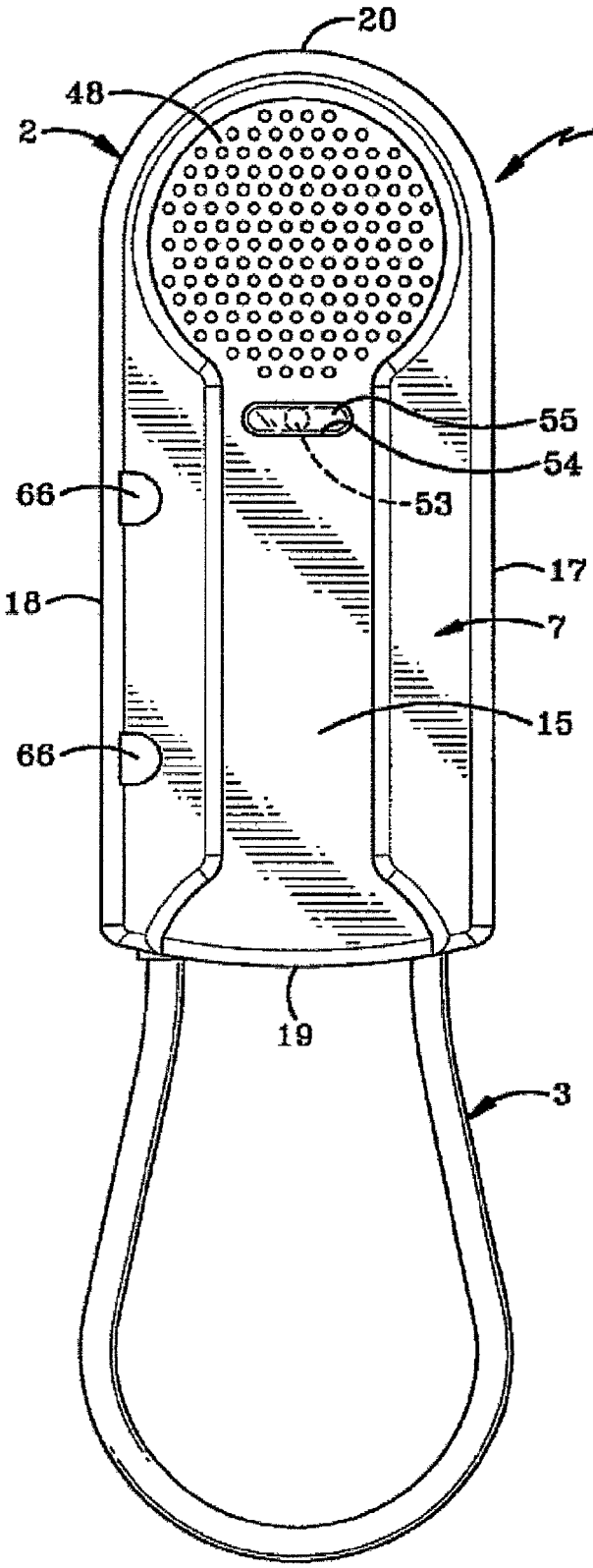
FIG. 1 is a plan view of a first embodiment of the cable alarm security device of the present invention.
Figure 2:
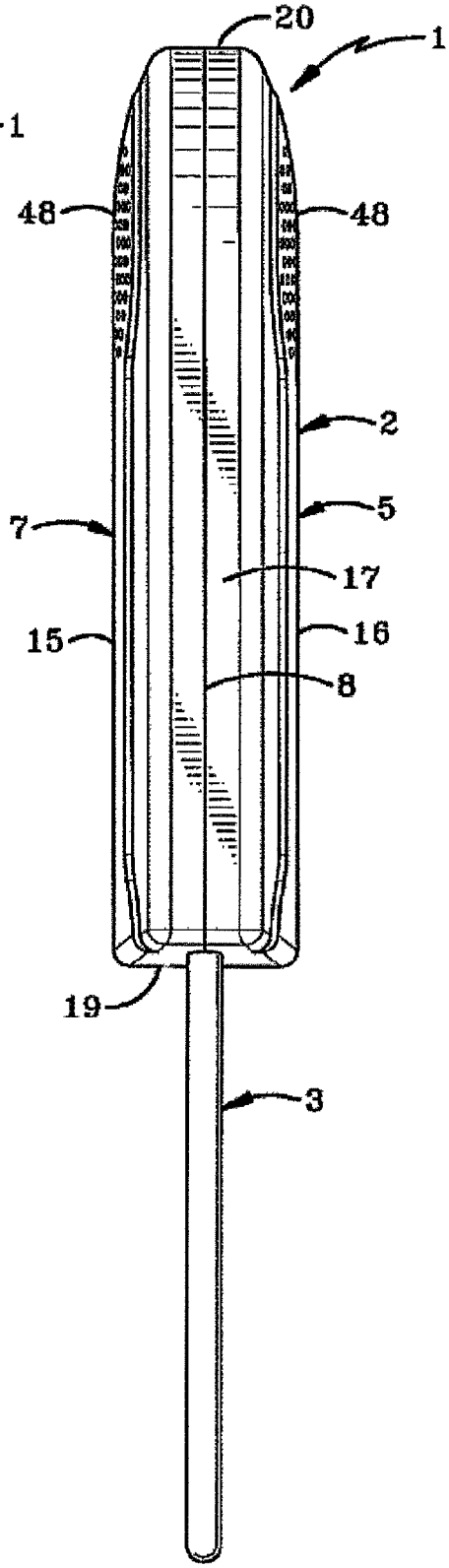
FIG. 2 is a right side elevational view of the security device of FIG. 1.
Figure 3:
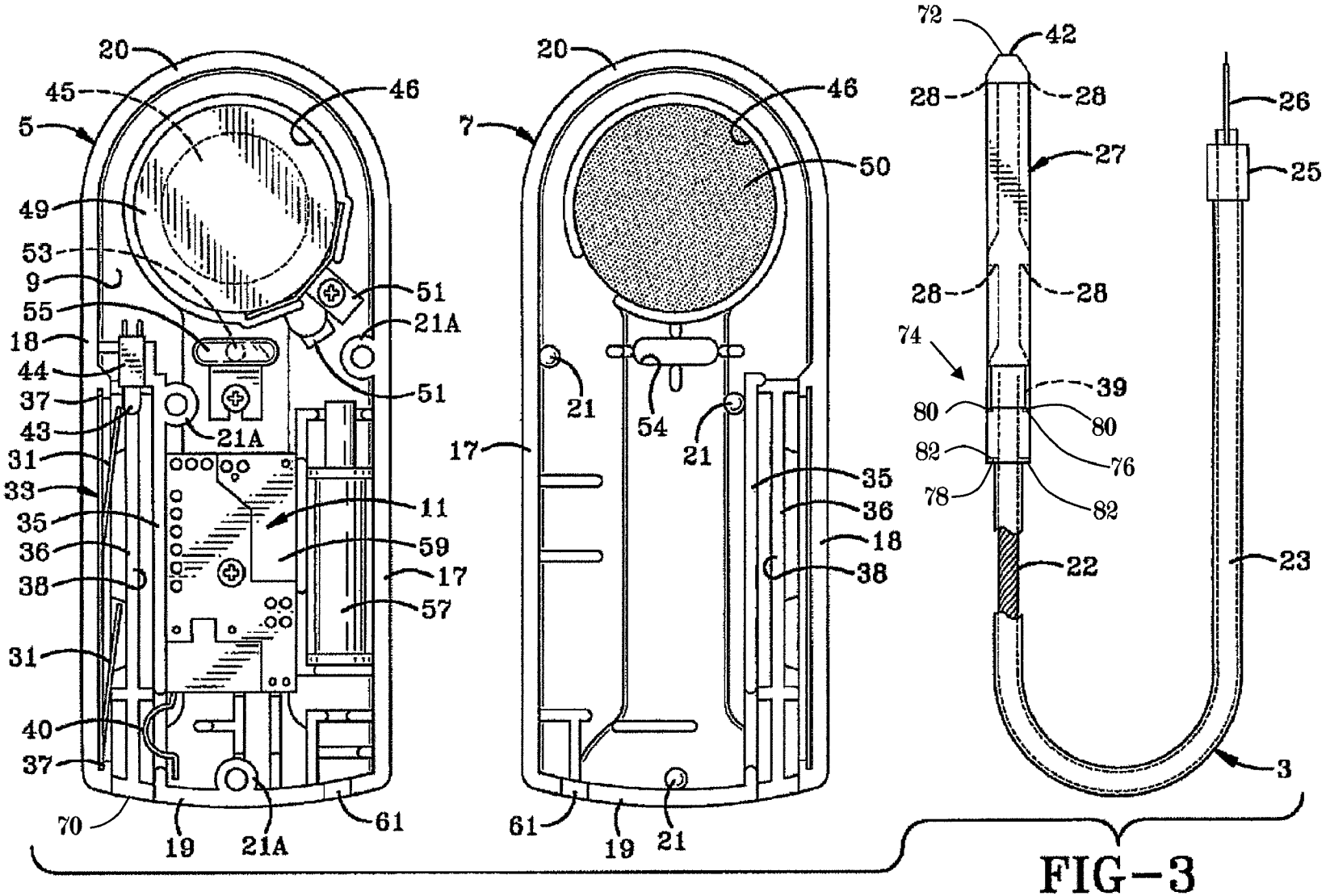
FIG. 3 is an exploded plan view of the security device of FIGS. 1 and 2.

An example of a preferred cable alarm security device of the present invention is indicated generally at 1, and is shown in FIGS. 1-7. The cable alarm security device 1 includes a main housing 2 and a locking cable 3. As can be seen in FIG. 3, for example, the housing 2 includes two generally half body members indicated generally at 5 and 7, which are secured together such as with an adhesive or sonic weld, along a seam 8 which extends in a continuous manner completely about the housing as shown in FIGS. 1 and 2. The housing members 5, 7 preferably are molded of a rigid plastic material and form a hollow internal chamber 9 in which is mounted an alarm system indicated generally at 11 (FIG. 3), the details of which are discussed further below, and a lock mechanism indicated generally at 13.

The housing 2 has a relatively elongated relatively flat configuration as shown in FIGS. 1 and 2, wherein the thickness (FIG. 2) is considerably less than its length (FIG. 1). This provides a relatively compact yet pleasingly attractive device. The housing 2 includes a pair of spaced side walls 15, 16, a pair of spaced edge walls 17, 18, and a pair of opposed spaced end walls 19, 20. As discussed above, the connecting seam 9 extends continuously along the edge walls 17, 18 and the end walls 19, 20 when the two half body housing members 5, 7 are joined together as shown in FIGS. 1 and 2. The housing member 7 has three positioning posts 21 which extend into three bosses 21A formed on the housing member 5 to properly align the members together before final joiner thereof.

The locking cable 3 is best shown in FIG. 3 and includes an internal spirally-wrapped plurality of electrically conductive wires or cords that form an internal cable conductor 22 covered by a dielectric installation 23. While not being limited to a particular theory, the internal cable conductor 22 provides both the electrical path for a cable sensing loop as well as the mechanical strength for the cable. The locking cable 3 is a conductive mechanical connector that terminates at a proximal end with a connector (e.g., ferrule) 25, preferably having a rounded barrel-like configuration and formed of an electrically conductive metal which, when secured to the cable, is in electrical contact with the conductor 22. Another conductor 26 is attached to and extends from the connector 25 for electrically connecting the cable 3 to the alarm system 11. A locking plug or bayonet plug indicated generally at 27 is a locking member secured to the other (distal) end of the cable 3 via a connector or ferrule 39, as is discussed in greater detail below. The locking plug 27 preferably is formed of a dielectric plastic material and has a pair of locking shoulders 28 formed thereon, (FIG. 4), which when in a locked position engage a pair of spring biased metal tines 31. The connectors 25, 39, locking member and conductive mechanical connector (e.g., cable 3) form an exemplary article holding member for attaching the security device to an article (e.g., clothing, bottle, item of merchandise). It is understood that the article holding member is not limited to a cable, and may include other types of conductive mechanical connectors within the scope of the invention including, for example, conductive straps, conductive collars, wire, pins, and a plurality of cables (separate or connected).

Figure 4:
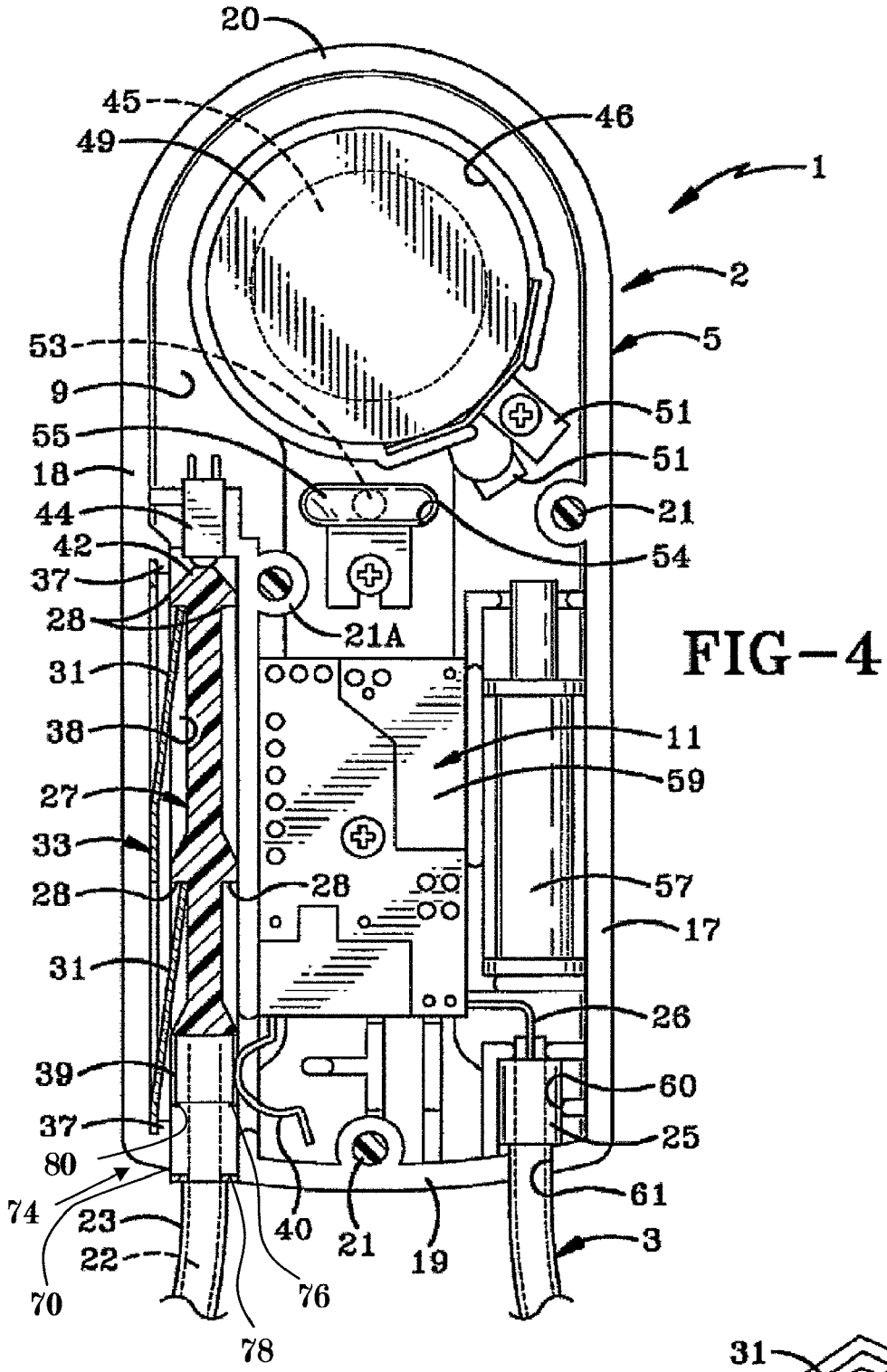
FIG. 4 is a plan view of the housing of the security device containing the alarm system components therein with the bayonet plug in a first locked position.
Figure 4A:
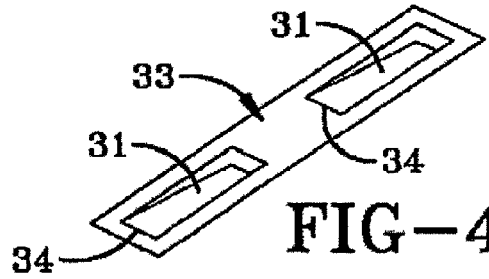
FIG. 4A is a perspective view of the magnetically attractable locking member of the lock mechanism removed from the housing of FIG. 4.

The tines 31 preferably are lanced from a flat spring metal strip of material 33 (FIG. 4A) so as to extend in an outwardly direction as shown in FIG. 4. The tines 31 are integrally connected to the strip 33 by hinge segments 34 in order to be easily moved to their original position along and as a part of the strip 33, as shown for example in FIG. 5. The metal strip 33 is secured within the housing 2 by extending into slotted openings formed by a pair of tabs 37 as shown in FIG. 4, whereby the tines 31 extend into a locking channel 38 formed in the housing. The locking channel 38 is formed between an edge wall 18 and ribs 35 (FIG. 3) that extend parallel with and spaced from the wall 18. Another rib 36 is formed on the side walls 15, 16 and extends along and assists in forming the locking channel 38 for securely retaining the locking plug 27 therein.

Figure 5:
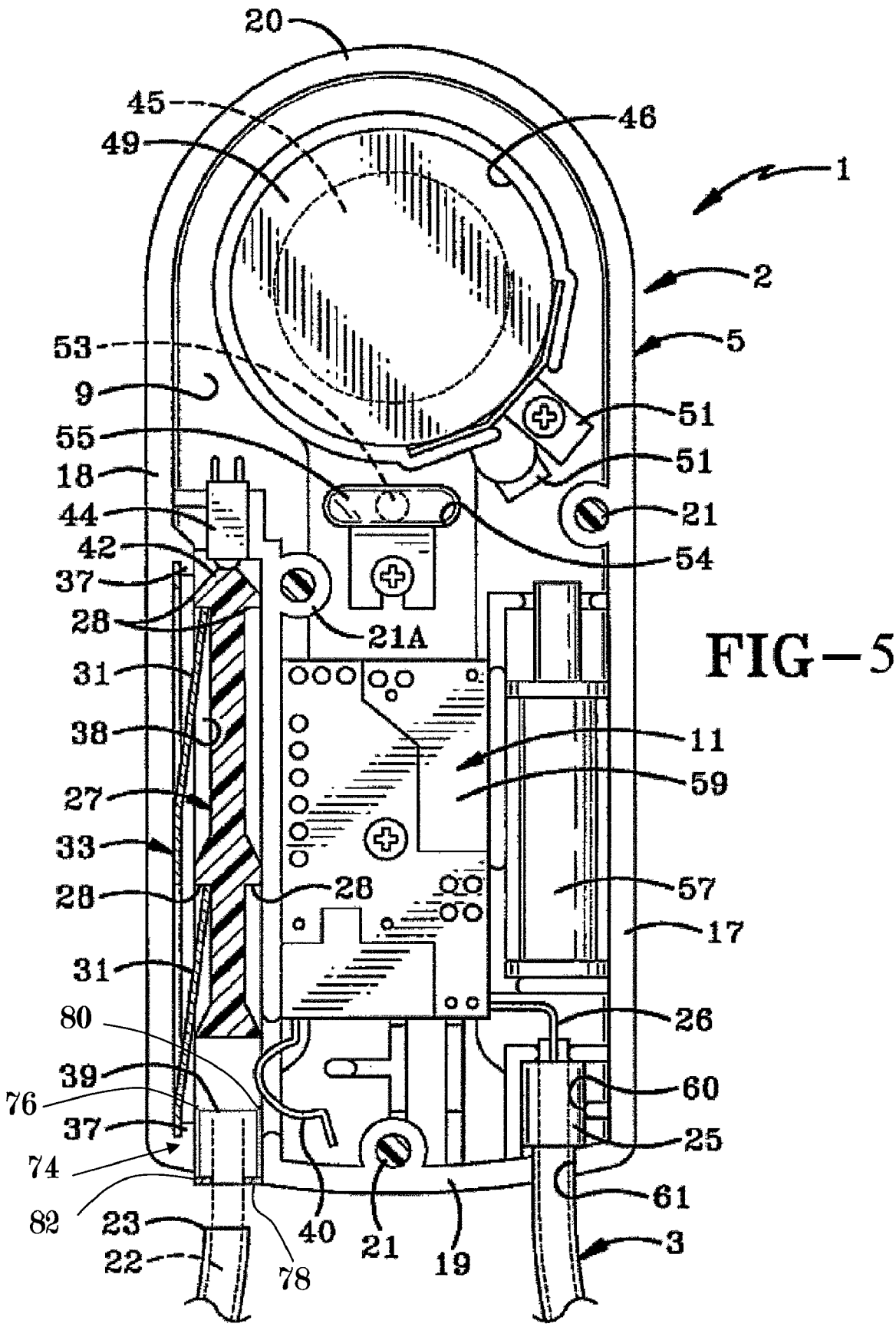
FIG. 5 is a plan view of the housing of the security device containing the alarm system components therein with the locking plug in a second locked position.
Figure 6:
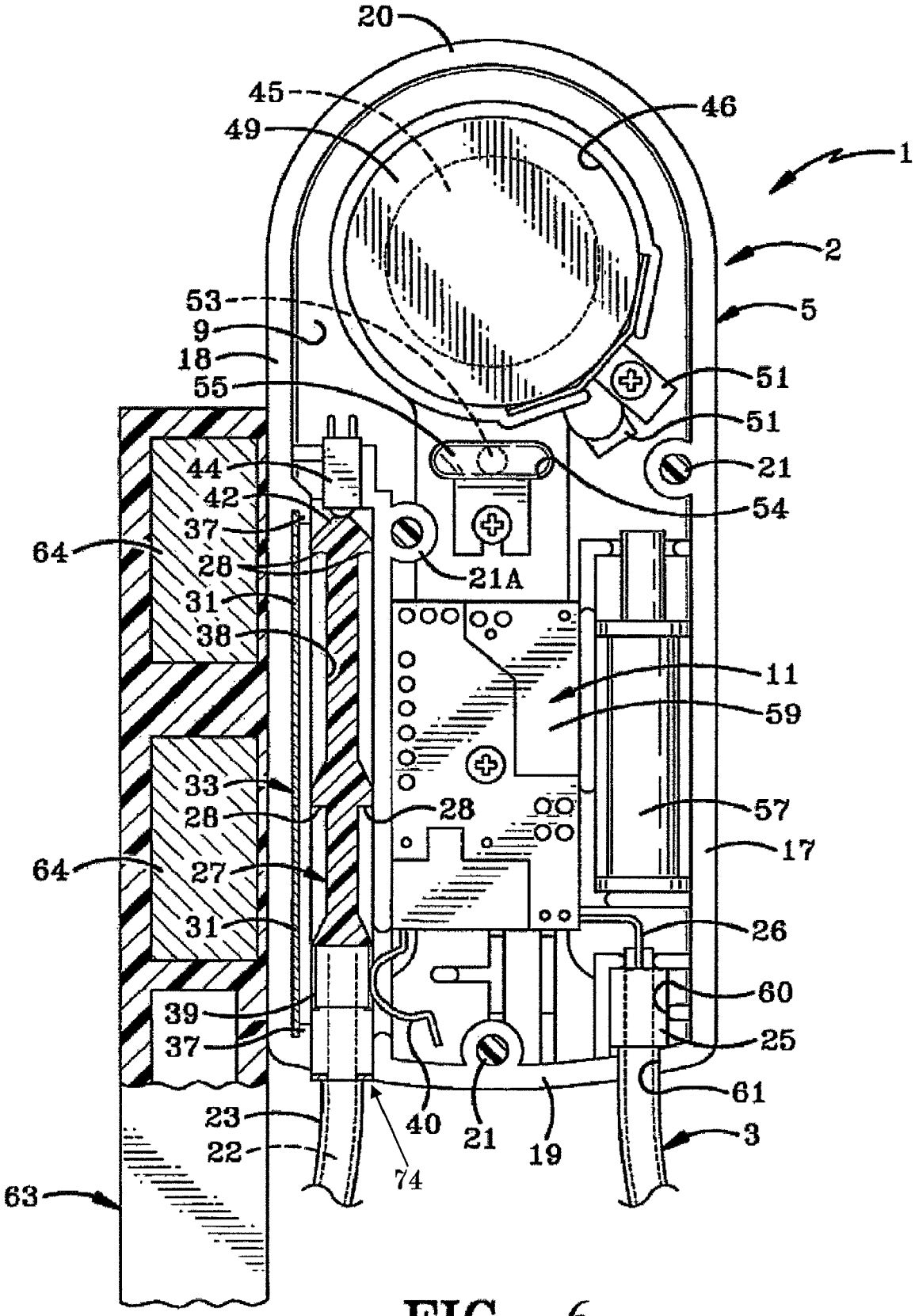
FIG. 6 is a view similar to FIG. 4 showing a magnetic key moving the locking member of FIG. 4A to the unlocked position.
Figure 7:
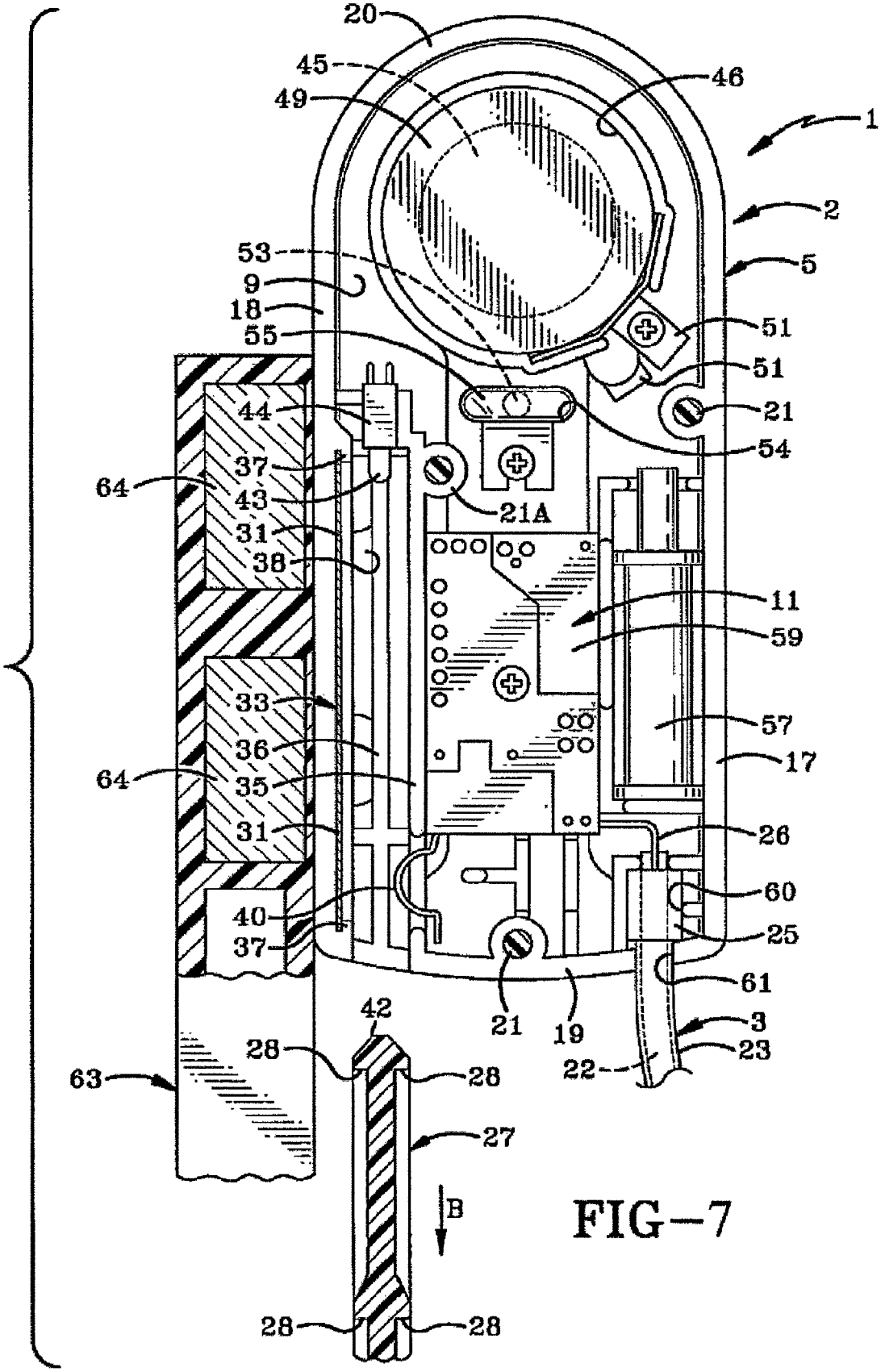
FIG. 7 is a view similar to FIG. 6 with the locking plug removed from the housing.

The locking plug 27 has a generally elongated elliptic cylindrical configuration, and has two pairs of locking shoulders 28 formed on opposite sides thereof, as shown for example in FIGS. 4, 5, and 6. This configuration enables the plug 27 to be inserted into the locking channel 38 in either of two directions facilitating the locking of the locking cable 3 about or through an article of merchandise. As can be seen in FIG. 4, the locking plug 27 could be rotated 180 degrees, inserted into the locking channel 38 and still be locked therein by the tines 31.

While not being limited to a particular theory, the locking plug 27 preferably is a bayonet generally having an oval transverse and elongated longitudinal shape (e.g., elliptically cylindrical). Moreover, when matched in configuration with the oval bayonet, the locking channel 38 of the locking mechanism has a generally oval shaped receiving mouth 70. This enables the locking plug 27 to be inserted into the locking channel 38 in either of two directions facilitating the locking of the locking cable 3 about or through an article of merchandise, as would readily be understood by a skilled artisan. In addition, the oval cross-sectional shaped takes up less space than a circular or rectangular bayonet, while providing locking shoulders 28 on the wider, less arcuate, opposite sides of the bayonet and thereby having a greater latch engagement area with the tines 31, especially in comparison to a circular cylindrical bayonet. The locking shoulders 28 thus allow alternate alignment—the bayonet can be faced either of two ways, with greater strength through a longer latch engagement area on the wider side of the bayonet.

The locking plug 27 further includes a truncated oblique cone-shaped distal end 42 with a blunt tip 72 that initiates contact with the oval shaped mouth 70 of the locking channel 38. This distal end 42 is thereby shaped to self-align the bayonet locking plug 27 into either of its locking configurations (e.g., by chamfering) as can best be seen in FIGS. 4 and 5. That is, as the locking plug 27 is inserted into the matching shaped locking channel 38, the locking plug rotates as needed from its initial contact with the locking channel into one of its alternate orientations in order to continue into the locking channel and into locking engagement with the tines 31.

Referring to the locking cable 3 shown in FIGS. 3-6, a second metal crimp connector 39 (also referred to as "ferrule") similar to connector 25, is crimped to the distal end of the internal cable conductor 22 and is at least initially connected to the internal alarming system 11 when in the locked position by engaging a spring metal clip 40, which is electrically connected to the internal alarm system. As can be seen in FIG. 4, the connector 25 on the proximal end of cable 3 is electrically connected to the alarm system via an attached conductor 26 and is electrically connected to the alarm system at the distal end of the cable by the ferrule 39 being in electrical contact with the metal clip 40. As discussed above, the metal clip 40 is also electrically connected to the alarm system, thus completing an electrical circuit or sense loop through the cable 3.

Still referring generally to FIGS. 3-6, and in particular to FIG. 3, the ferrule 39 connects to the bayonet locking plug 27. The locking plug includes a two-step ferrule holder as the mechanical fuse that provides defeat prevention of the alarm device. In particular, the ferrule holder 74 includes a defeat latch 76 and a recovery latch 78. The defeat latch 76 includes one or more holding members 80 that initially abut the ferrule 39 and hold the ferrule in a first locking position. As can best be seen in FIG. 4, when the bayonet locking pin 27 is locked in the locking channel 38 by the tines 31, the defeat latch 76 holds the ferrule 39 in an electrically connected position, with the ferrule electrically connected to the internal alarming system 11 via the metal clip 40. The holding members 80 of the defeat latch 76 are shown by example as plastic tabs or bumps configured to hold the ferrule 39 during normal pulling forces on the locking cable 3 between the locking plug 27 and the internal cable conductor 22, and to release the ferrule 39 upon greater pulling forces (e.g., greater than 40 lbs/ft$^2$) that indicate someone or something is tampering with the locked security device 1 to possibly remove the security device from its attached article of merchandise.

The recovery latch 78 is adjacent the defeat latch and includes one or more holding members 82 that are preferably stronger than the holding members 80 of the defeat latch. That is, the holding members 82 of the recovery latch 78 are configured to hold the ferrule 39 in a second locking position adjacent the first locking position and to withstand greater pulling forces than required of the holding members 80 to hold the ferrule when the defeat latch fails. When a pulling force applied to the internal cable conductor 22 causes the ferrule to overcome the hold of the defeat latch 76 and to separate from connection with the metal clip 40, the recovery latch 78 stops and holds the ferrule 39 in the second locking position, as can be seen in FIG. 5. The second locking position is not an electrically connectable position as the ferrule 39 is spatially separate from the metal clip. Therefore the movement of the ferrule 39 from the first locking position to the second locking position opens the sense loop or electrical circuit, causing the security device 1 to alarm. However, during this defeat prevention alarm, the security device 1 remains locked and attached to its article of merchandise. Accordingly, the locked security device detects tampering and alarms if pulled too hard from twisting or pulling the cable without releasing the primary lock when the defeat latch fails. Any attempt to defeat the recovery latch and remove the security device 1 from its article of manufacture thus occurs while the security device is alarming.

When the locking plug 27 is in the locked position, the distal end 42 thereof engages and compresses a plunger 43 of a plunger switch 44 from its open position shown in FIG. 3 to its closed position shown in FIG. 4. The plunger switch 44 is electrically connected in the circuitry of the alarm system 11 and will complete the circuit to an audible alarm 45 located within housing 2 as is readily understood by a skilled artisan. The audible alarm 45 is mounted in a circular boss 46 located adjacent a pair of perforated areas 48 formed in the upper portions of the side walls 15 and 16, which form opposed grill-like portions of the housing. A battery 49 is also mounted in the circular boss 46 (FIG. 3) and covered by a foam pad 50. The battery 49 supplies the electrical power for the alarm system 11 through the terminals 51.

An LED 53 is mounted within the chamber 9 of the housing 2 and is electrically connected to the battery 49. While not being limited to a particular theory, the LED 53 is located adjacent a pair of opposed aligned openings 54 formed in the housing side walls 15, 16, in which may be mounted lenses 55. The LED preferably will provide a blinking light when the alarm system is activated, which will preferably be readily visible from both sides of the housing by store personnel as well as potential shoplifters to advise them that an alarm system is activated, further protecting the item of merchandise to which the device 1 is attached from theft. While the LED 53 is shown in FIG. 3 below the circular boss 46 and battery 49, it is understood that the LED, and the opposed aligned openings 54 could alternatively be placed at other areas in the housing 2 and at other locations relative to and spaced from the circular boss within the scope of the invention. It is likewise understood that the components of the alarm system 11 and the lock mechanism 13 could be arranged at alternative areas within the housing 2 while maintaining well within the scope of the invention.

An EAS tag 57 is located within the chamber 9 of the housing 2 and can have various configurations, such as the coil configuration as shown in FIGS. 3-7. The tag 57 preferably is a magnetically sensitive device or an RF (radio) sensitive device, which are the two most common forms of EAS tags and associated sensing systems used today. The EAS tag 57 will actuate the internal audible alarm 43 by receiving signals from a secured gate, as discussed further below, as well as actuating the security gate alarm as do most EAS tags contained within a secured device.

While not being limited to a particular theory, the alarm system 11 includes a solid state circuit board 59, which is mounted on housing member 5 (FIGS. 3 and 4) as would readily be understood by a skilled artisan.

As shown in FIG. 4, the cable end connector 25 is mounted permanently within the housing 2 and is seated within a compartment 60 formed in a lower corner of the housing with the cable 3 entering the housing through a circular opening 61 formed in the end wall 19. The cable end connector may also be part of a defeat prevention mechanism as discussed in greater detail below.

The locking plug 27 is shown in a locked position in FIGS. 4 and 5 with the distal ends of spring biased tines 31 engaged with the shoulders 28 preventing the removal of the plug 27 from the locking channel 38. In this position, the plunger switch 44 is actuated, as well as the electrical connection made with the alarm system 11 through the spring biased clip 40.

To unlock the locking mechanism of the security device 1 (FIG. 6), a magnetic key indicated generally at 63, is used to move the metal tines 31 from their locked position shown in FIGS. 4 and 5 to the unlocked position shown in FIG. 6 by attracting them in the direction of Arrows A (FIG. 6). The key 63 preferably contains a pair of internal magnets 64 which are positioned at a certain location therein so as to accurately align with the tines 31 in order to exert a sufficiently large magnetic attraction thereon for their movement to the unlocked position. A pair of alignment notches 66 is formed on both housing side walls 15, 16 to align with positioning tabs (not shown) formed on the magnetic key 63 to ensure that the internal magnets 64 properly align with the tines 31. It has been found that such a magnetic key having the pair of magnets which properly align with the metal tines provides increased security than if only a single metal tine and corresponding single magnet were utilized. However, other types of magnetic unlocking key arrangements can be used without affecting the concept or scope of the invention. After the tines have been moved to their unlocked position of FIG. 6, the locking plug 27 is removable from the locking channel 38 when pulled easily out of the channel in the direction of Arrow B (FIG. 7), enabling the cable 3 to be removed from a selected item of merchandise.

Figure 8:
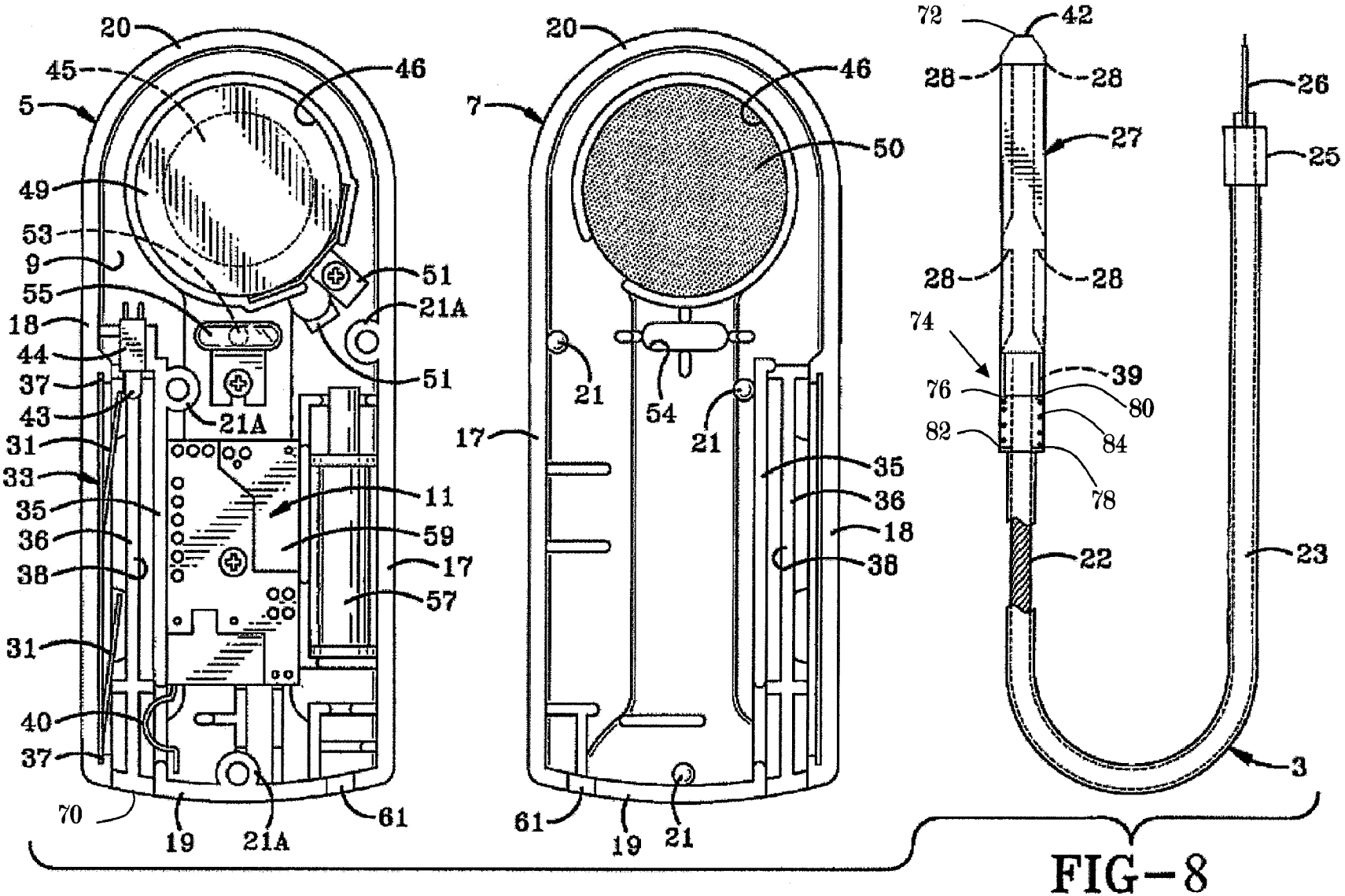
FIG. 8 is an exploded plan view of the security device of FIGS. 1 and 2 including a spring as part of the ferrule holder in accordance with another example of the preferred embodiments.
Figure 9:
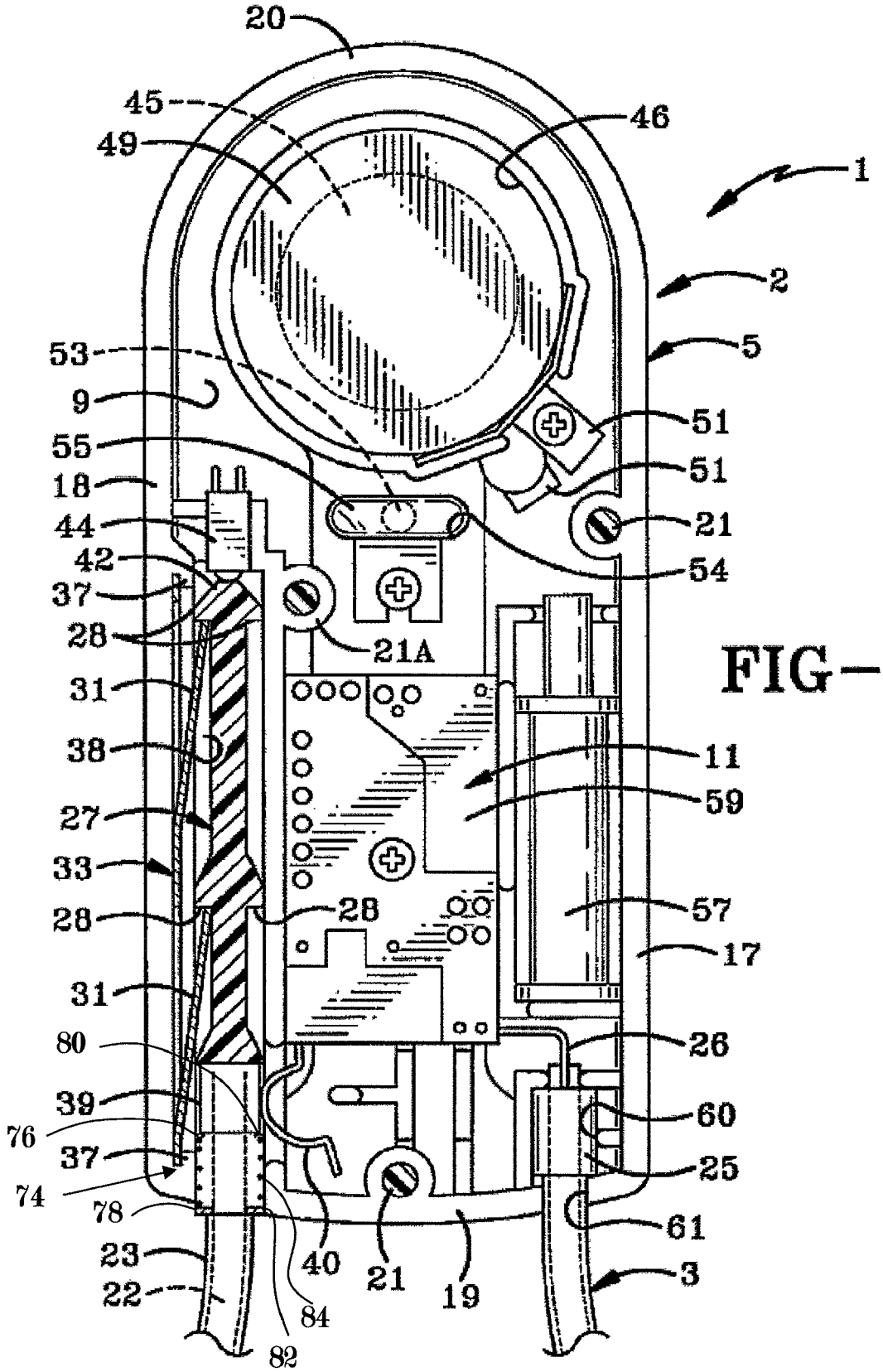
FIG. 9 is a plan view of the housing of the security device containing the alarm system components therein with the bayonet plug in a first locked position and a spring as part of the ferrule holder.
Figure 10:
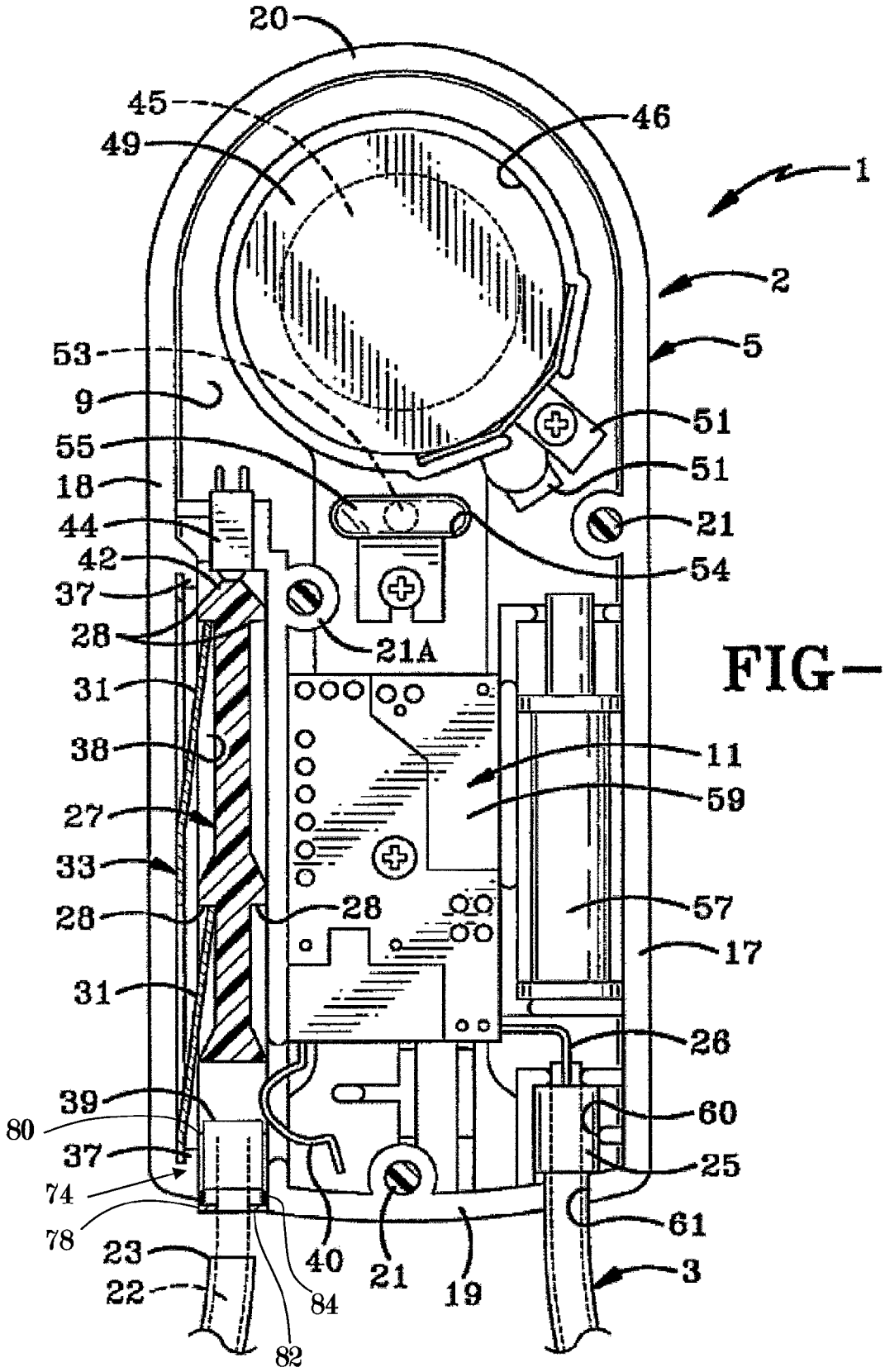
FIG. 10 is a plan view of the housing of the security device containing the alarm system components therein with the locking plug in a second locked position and a spring as part of the ferrule holder.

In the exemplary embodiment disclosed above, the 2-stage alarm preferably operates by deforming the holding members 80 (e.g., little plastic tabs or bumps) of the defeat latch 76 if pulled or tugged really hard. The force of the pull overcomes the tabs but does not release the ferrule 39 out of the ferrule holder 74 of the bayonet locking plug 27. However, once deformed, the plastic tabs do not hold as well if a retailer wanted to re-set the security device 1. Therefore, as can be seen in FIGS. 8-10, the inventors disclose another example of the preferred embodiment with the ferrule holder including a compression spring 84 usable with or instead of the holding members 80 (e.g., plastic tabs or bumps). The compression spring 84, which either abuts the holding members 80 or the ferrule 39, is preferably formed of metal, and can be overcome if the cable 3 is tugged too hard (e.g., over 40 lbs/ft$^2$). The spring 84 allows the ferrule 39 to pull out of contact with the metal clip 40 to activate the electronic alarm, yet resets the ferrule in the ferrule holder 74 upon releasing the tug for reuse of the security device.

FIGS. 8-10 are similar to FIGS. 3-5 with the addition of the spring 84 between the holding members 80 of defeat latch 76 and the recovery latch 78. If a pull on the cable 3 defeats the holding members 80, the spring 84 remains between the ferrule and the recovery latch and biases the ferrule toward the distal end 42 and away from the recovery latch 78. An advantage of the spring 84 is that the ferrule holder 74 would be more easily resettable by pushing the ferrule 39 back into position, or alternatively by just releasing the pulling force. That is, the spring would not be ruined by the ferrule overcoming the defeat latch.

While the compression spring 84 is shown abutting and supporting the holding members 80 against the connector 25, it is understood that the spring may also directly abut the ferrule 39 within the scope of the invention. It is also understood that the spring 84 could be used as the defeat latch 76 without the holding members 80. In these examples the spring 84 abuts the ferrule 39 directly and biases the ferrule toward the distal end 42 and away from the recovery latch 78.

Additional examples of the preferred embodiments are discussed below having modifications to the examples discussed above, while maintaining within the scope of the invention. For example, an additional conductive loop may be added to the sense loop, in series or parallel to avoid possibly defeating the cable lock by splicing the cable 3. Further, an additional or alternative defeat prevention mechanism may be applied at the fixed or proximal end of the cable 3, as will be discussed by example in greater detail below. Yet still another example of the preferred embodiments is also set forth below with both ends of the cable being removably attachable to the housing of the lock.

Figure 11:
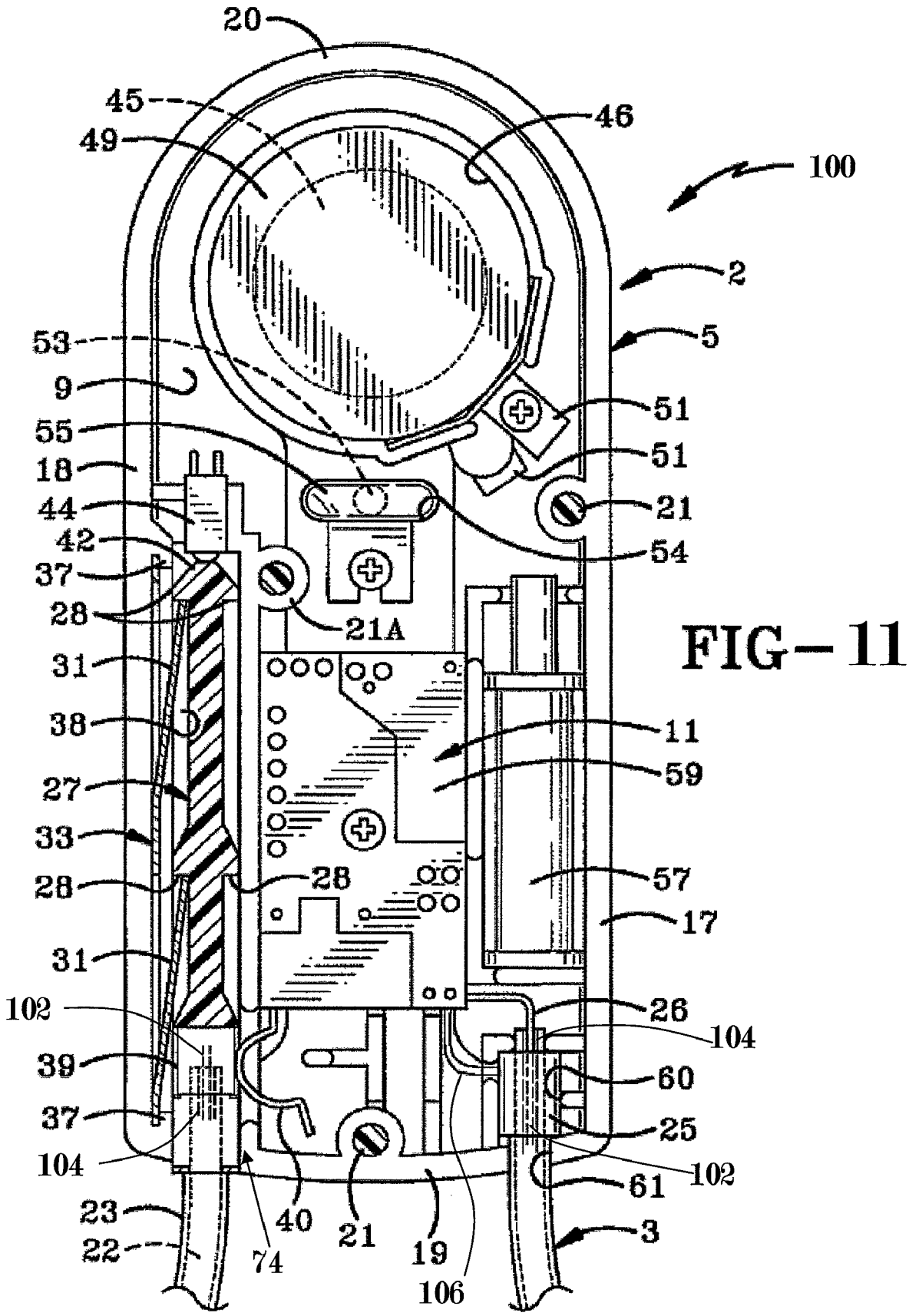
FIG. 11 is a plan view of the housing of the security device containing the alarm system components therein with the bayonet plug in a first locked position in accordance with another example of the invention.

FIG. 11 depicts an exemplary security device 100 containing the alarm system components therein with the locking plug in a first locked position. The security device 100 is substantially similar to the security device 1, and adds a conductive loop in series with the sense loop discussed above. In particular the cable 3 includes the dielectric insulation 23 wrapped around the internal (first) cable conductor 22, and further includes a second cable conductor 102 insulated by a dielectric jacket 104 from the internal cable conductor. While not being limited to a particular theory, the second cable conductor 102 is preferably embedded within the internal cable conductor 22, and is conductively insulated from the internal cable conductor with the dielectric jacket 104 wrapped around the second cable conductor. In this configuration the internal cable conductor 22 of the cable 3 is wrapped around the dielectric jacket 104 and conceals the jacket and second cable conductor 102 from view, generally as the dielectric insulation 23 wrapped around the internal cable conductor conceals the internal cable conductor from view.

While FIG. 11 shows the second cable conductor 102 embedded within the internal cable conductor 22, it is understood that the second cable conductor is not limited to an embedded location within the internal cable conductor and may alternatively be located surrounding the internal cable conductor, for example, as a conductive sleeve wrapped around the dielectric insulation 23. The second cable conductor 102 may be copper, steal or another conductive material as readily understood by a skilled artisan. It is most preferable that the second cable conductor 102 is concealed as a conductive member and coupled to the circuit board 59 as part of the sense loop in series or parallel with the internal cable conductor 22. In this manner, a person trying to defeat the cable lock 100 by splicing the internal cable conductor 22 is unaware of the second cable conductor 102, which maintains the sense loop along the cable 3 even if the internal cable conductor is spliced in an attempt to bridge the sense loop across an alternative path between the ends of the cable 3. If the person splicing the internal cable conductor 22 and not the second cable conductor 102 then completely cuts the cable 3 to remove the security device 100 from an attached article, the second cable conductor is also cut and opens the sense loop, regardless of the location of the cable cut. The opening of the sense loop triggers the alarm. Accordingly, the security device 100 is not defeated by a splice of its internal cable conductor.

Figure 12:
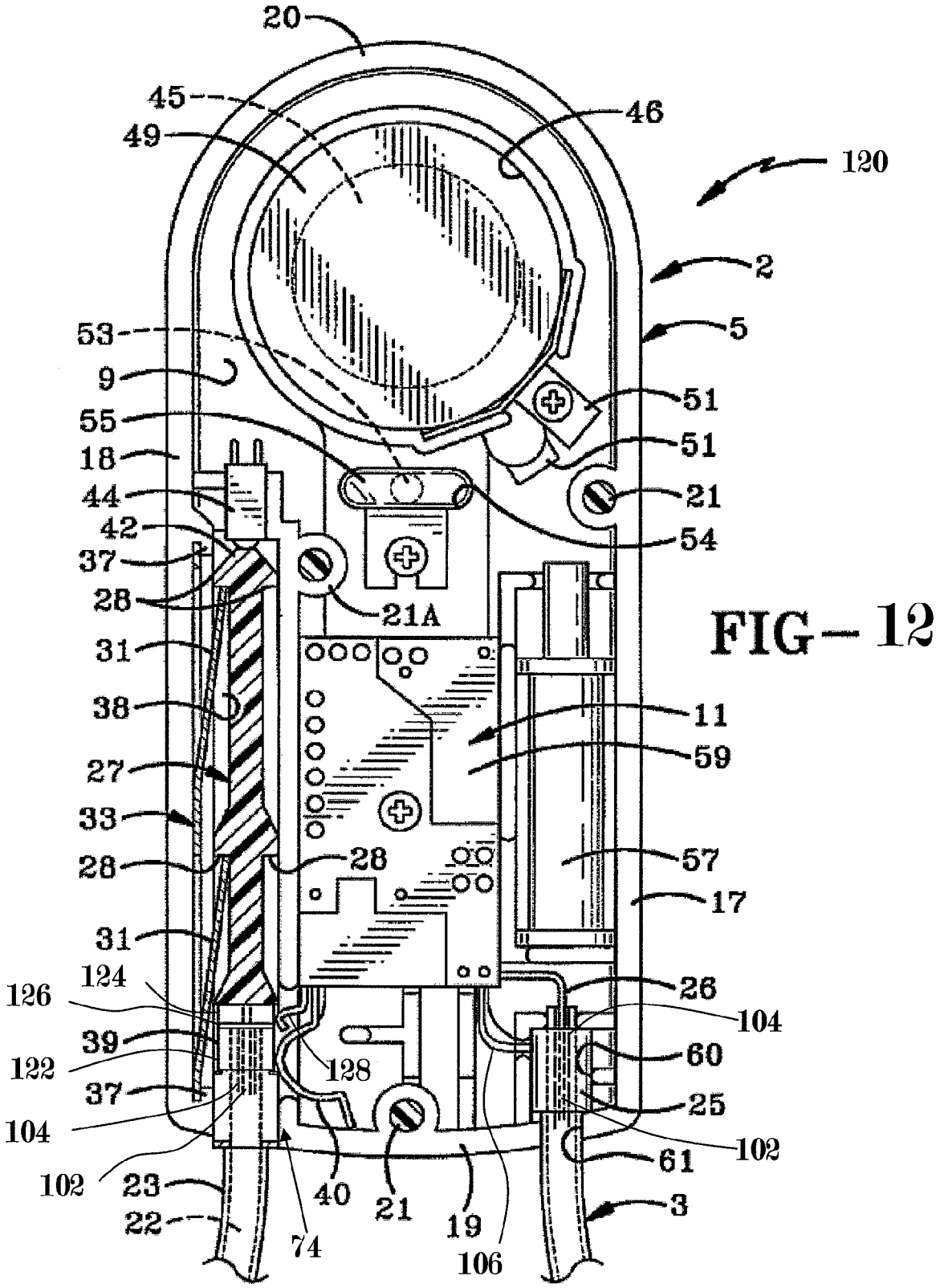
FIG. 12 is a plan view of the housing of the security device containing the alarm system components therein with the bayonet plug in a first locked position in accordance with yet another example of the invention.

As noted above, the second cable conductor is added to the sense loop either in series or parallel to the internal cable conductor 22. FIG. 11 shows an exemplary connection in series, and FIG. 12 shows an exemplary connection in parallel. Referring to FIG. 11, the internal cable conductor 22 is conductively coupled to the connector 25, which is shown as a ferrule. A conductor 26 is attached to and extends from the connector 25 to the circuit board 59 for electrically connecting the internal cable conductor 22 of the cable to the alarm system 11. The conductor 26 is substantially similar to the conductor 26 shown in FIGS. 3-10. However, instead of conductively and mechanically coupling directly to the internal cable conductor, the conductor 26 is conductively coupled to the internal cable conductor 22 via the connector 25 as shown, for example, in FIG. 11. In addition, a second conductor line 106 is mechanically and conductively coupled to the second cable conductor 102 and the circuit board 59 to form a backup loop to the alarm system 11. It should be noted that the second cable conductor 102 is conductively isolated from the connector 25 via the dielectric jacket 104, so that the second cable conductor remains conductively isolated from internal cable conductor 22 at this proximal end of the cable 3 and throughout the cable as desired. It is understood that the approach for coupling the conductor 26, and the second conductor line 106 to the internal cable conductor 22 and the second cable conductor 102, respectively, is not limited to a particular construction, and that the arrangement for connection may be influenced by spatial or conductive limitations of the second cable conductor 102, for example, whether the second cable conductor is inside or outside of the internal cable conductor.

As can be seen in FIG. 11, the backup loop is attached to the sense loop in series by coupling the internal cable conductor 22 and the second cable conductor 102, preferably at the locking plug 74. Most preferably the internal cable conductor 22 and second cable conductor 102 are coupled near the distal end of the cable 3 at a location that is within the locking channel 38 when the locking plug 27 is inserted and locked in the locking channel, so that the area of coupling is generally inaccessible to a person when the security device 100 is locked. For example, in FIG. 11, the ferrule 39 conductively couples the internal cable conductor 22 and the second cable conductor 102, preferably by crimping onto both conductors to establish both a mechanical and a conductive connection to both conductors.

FIG. 12 depicts a security device 120 substantially similar to the security device 100, but with the second cable conductor 102 added to the sense loop in parallel to the internal cable conductor 22. In FIG. 12, the majority of the cable 3, including the proximal end thereof is substantially similar to the cable shown in FIG. 11. In particular, the internal cable conductor 22, the connector 25, the conductor 26, the second conductor line 106, and the second cable conductor 102 are shown and depicted as shown in FIG. 11.

In order to connect the additional loop to the sense loop in parallel, the internal cable conductor 22 and the second conductor line 106 at the distal end of the cable (e.g., the end mechanically coupled to the ferrule holder 74 of the locking plug 27) remain conductively isolated from each other and separately couple to the sense loop. For example, the ferrule 39 includes a first ferrule section 122 and a second ferrule section 124 conductively isolated from each other by a dielectric insulator 126 there between. The first ferrule section 122 exemplified in FIG. 12 is mechanically and conductively coupled to the internal cable conductor 22, as the ferrule 39 is mechanically and conductively coupled to the internal cable conductor 22 in FIG. 4. Still referring to FIG. 12, the second cable conductor 102 and dielectric jacket 104 extend through the first ferrule section 122 to keep the second cable conductor conductively isolated from the internal cable conductor 22 and the first ferrule section 122. The second cable conductor 102 preferably extends beyond the dielectric jacket 104 and past the dielectric insulator 126, where it is conductively coupled to the second ferrule section 124. While not being limited to a particular theory, the second ferrule section 124 preferably crimps the second cable conductor 102 to mechanically and conductively couple the two together.

The first ferrule section 122 is at least initially connected to the internal alarming system 11 when the locking plug 27 is in the locked position by engaging the spring metal clip 40, which is electrically connected to the internal alarm system. Similarly the second ferrule section 124 is at least initially connected to the internal alarming system 11 when the locking plug 27 is in the locked position by engaging a second spring metal clip 128, which is also electrically connected to the internal alarm system. The spring metal clip 40 and the second spring metal clip 128 are spatially separate to independently conductively connect to the alarm system in parallel and form the sense loop.

As can be seen in FIG. 12, the first and second ferrule sections 122, 124 are attached to each other by the dielectric insulator there between to form the ferrule 39 as a two-part connector that moves within the ferrule holder 74 as the ferrule 39 moves with the ferrule holder shown in FIG. 4. That is, when a pulling force applied to the cable 3 causes the ferrule 39 to overcome the hold of the defeat latch 76—and spring 84 if used—and to separate from connection with the metal clips 40, 128, the recovery latch 78 stops and holds the ferrule 39 in the second locking position as can similarly be seen in FIGS. 5 and 10. Again, the second locking position is not an electrically connectable position as the ferrule 39 is spatially separate from the metal clips. Therefore the movement of the ferrule 39 from the first locking position to the second locking position opens the sense loop or electrical circuit, causing the security device 120 to alarm. However, during this defeat prevention alarm, the security device remains locked and attached to its article of merchandise. Accordingly, the locked security device detects tampering and alarms if pulled too hard from twisting or pulling the cable without releasing the primary lock when the defeat latch fails. Any attempt to defeat the recovery latch and remove the security device 1 from its article of manufacture thus occurs while the security device 120 is alarming.

Further, as discussed above in relation to the example of FIG. 11, a person trying to defeat the cable lock 120 by splicing the internal cable conductor 22 is unaware of the second cable conductor 102, which maintains the sense loop along the cable 3 even if the internal cable conductor is spliced in an attempt to bridge the sense loop across an alternative path between the ends of the cable 3. If the person splicing the internal cable conductor 22 and not the second cable conductor 102 then completely cuts the cable 3 to remove the security device 120 from an attached article, the second cable conductor is also cut and opens the sense loop, regardless of the location of the cable cut. The opening of the sense loop triggers the alarm. Accordingly, the security device 120 is not defeated by a splice of its internal cable conductor.

Figure 13:
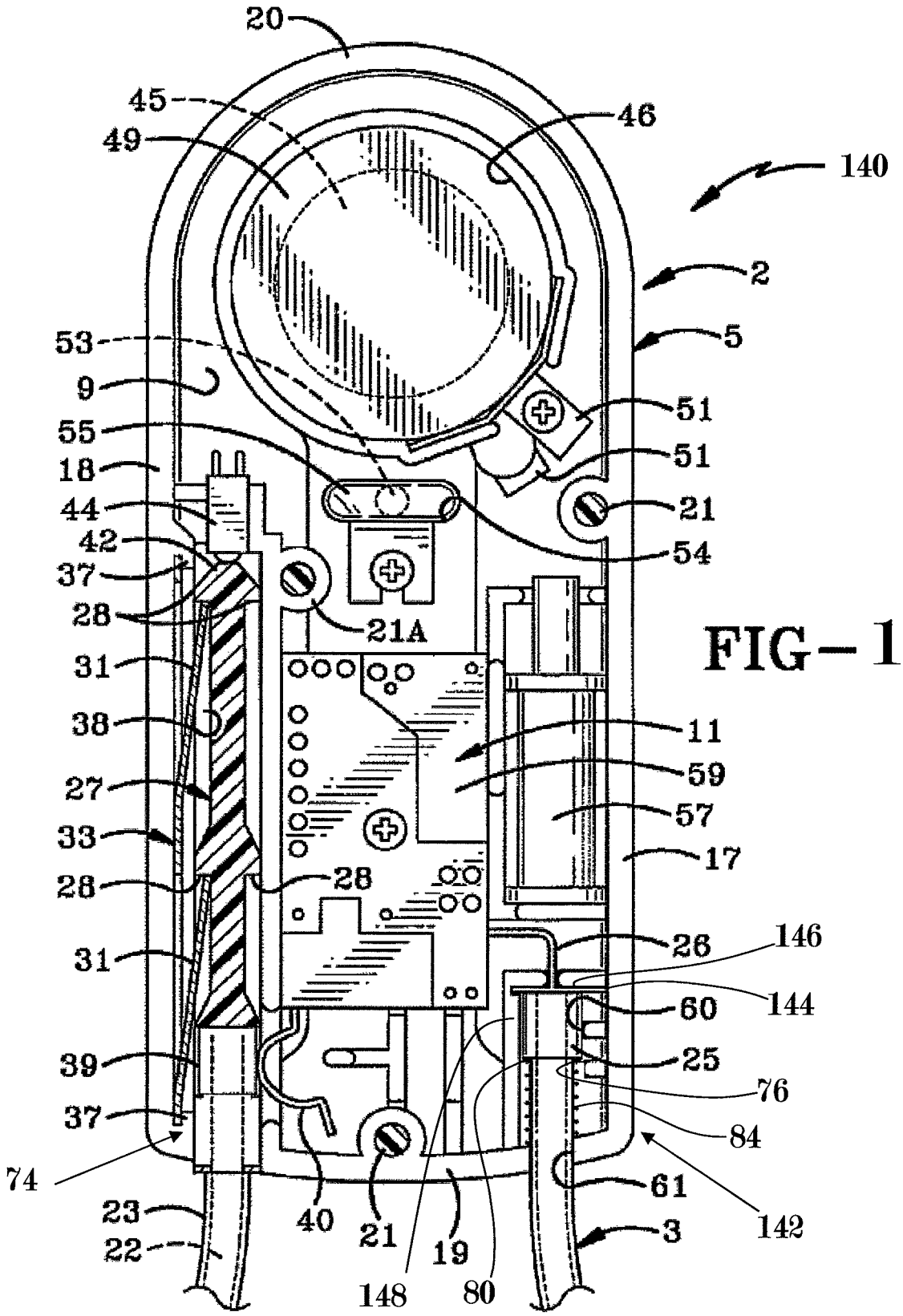
FIG. 13 is a plan view of the housing of the security device containing the alarm system components therein with the bayonet plug in a first locked position in accordance with still another example of the invention.

The preferred locking security devices of the invention include one defeat mechanism having a mechanical fuse (e.g., two-step ferrule) at one end of the cable. Yet it is understood that the invention is not limited to a security device with a single mechanical fuse or to a mechanical fuse at the distal end of the cable. FIG. 13 depicts yet another example of the preferred embodiments, with a locking security device 140 substantially similar to the other security devices 1, 100, 120, and having a defeat mechanism including a two-step ferrule holder 74 that provides defeat prevention of the alarm device. In addition, the security device 140 includes a second two-step ferrule holder 142 as a defeat mechanism located within the compartment 60 in the lower corner of the housing 2 where the cable 3 enters the housing through the circular opening 61 formed in the end wall 19. That is, in addition to the ferrule holder 74 being part of the locking plug 27 at the distal end of the cable 3, the second ferrule holder 142 is located in the housing 2 at the proximal end of the cable 3. This example demonstrates that the defeat mechanism of the preferred embodiments is locatable on the proximal and/or distal side of the cable, as described in greater detail below.

While not being limited to a particular theory, the security device 140 is shown having two two-step ferrule holders, one on each end of the cable 3. It should be understood that both two-step ferrules are shown together in this example as a showing that multiple two-step ferrules are available within the scope of the invention, and as an example of a two-step ferrule at the proximal end of the cable. It should also be understood that the second two-step ferrule alone is an example of a mechanical fuse within the scope of the invention. Therefore the preferred embodiments are not limited to a number or position of mechanical fuses, and are operable having a defeat mechanism including one mechanical fuse, or a plurality of mechanical fuses. Accordingly, it is understood that while the exemplary embodiment shows a second two-step ferrule in addition to a first two-step ferrule, that the example may also be considered as having a single two-step ferrule at the proximal end, and a common locking plug at the distal end attached to a connector conductively coupled to the alarm system to close the sense loop when the locking plug is locked to the housing.

The ferrule holder 142 is substantially similar to the ferrule holder 74 described above, and includes a defeat latch 76 having one or more holding members 80 that initially abut the connector 25 and hold the connector in a first locking position. The ferrule holder 142 includes a recovery latch shown, for example, as the end wall 19 adjacent the opening 61 formed in the end wall. The end wall 19 is stronger than the holding members 80 of the defeat latch. Accordingly, the end wall 19 is configured to hold the connector in a defeated locking position adjacent the initial locking position and to withstand greater pulling forces than required of the holding members 80 to hold the connector when the defeat latch 76 fails.

While not being limited to this feature, the ferrule holder 142 preferably includes a compression spring 84 for resetting the connector 25 that has been pull out of contact with the conductor 26 in the ferrule holder 74 for reuse of the security device 140. The defeat latch 76 and compression spring 84 are located between the connector 25 and the end wall 19. The compression spring 84 is shown abutting the connector 25, but may also abut and support the holding members 80 of the defeat latch 76 against the connector. Of course it is understood that the compression spring 84 is not required for the ferrule holder 74 to operate as the ferrule holder 74 described above in relation to FIGS. 4-6.

In the example depicted in FIG. 13, the connector 25 is crimped to the proximal end of the internal cable conductor 22 and is at least initially connected to the internal alarming system 11, regardless of if the locking plug 27 is in the locked position. The cable 3 is electrically connected at its proximal end to the alarm system via electrical contact between the connector 25 and the conductor 26 and is electrically connected to the alarm system at the distal end of the cable by the ferrule 39 being in electrical contact with the metal clip 40. As discussed above, the metal clip 40 and the conductor are also electrically connected to the alarming system, thus completing an electrical circuit or sense loop through the cable 3.

It should be noted that the connector 25 and conductor 26 are conductively coupled in a spatially separable manner different than the fixed mechanical and conductive coupling between the connector 25 and conductor 26 discussed above in regards to the examples shown in FIGS. 3-10. For example, the conductor 26 includes a conductive plate 144 that is sandwiched between the connector 25 and an internal retaining wall 146 partially defining the compartment 60 of the housing 2. The conductive plate 144 is a conductive extension of the conductor 26 that abuts the connector 25 to conductively couple the conductor and connector. In this example, the conductive plate 144 is fitted into the side retaining wall 148 and may also be fit into the spaced edge wall 17 if needed to hold the conductive plate 144 in its position regardless of the position of the connector 25.

It is understood that the conductive plate 144 is one of numerous extensions available to conductively couple the connector 25 with the alarming system 11 and that other conductive extensions that abut the connecter under normal forces are within the scope of the invention. For example, the conductive plate 144 may extend down the internal side retaining wall 148 a distance less than the longitudinal distance that the connector 25 could travel within the ferrule holder 142 upon a breach of the defeat latch 76. Moreover, the conductor 26 could extend through an internal side retaining wall 148 partially defining the compartment 60 of the housing 2 and conductively contact the connector 25 as shown by example in FIGS. 11 and 12. As can be seen in FIGS. 11 and 12, this connection shown by the conductor line 106 abuts the connector 25 on its cylindrical side wall and allows some initial movement of the connector 25 away from the internal retaining wall 146 before opening the sense loop. These approaches add the benefit of preventing false alarms from only a microscopic separation between the connector 25 and the conductive plate 144 by requiring a breach of the defeat latch 76 and movement of the conductor/ferrule 25 greater than a microscopic distance.

As can be seen in FIG. 13, the connector 25 and conductor 26 are conductively connected by the defeat latch 76 and/or compression spring 84, which hold the connector against the conductor during normal pulling forces on the locking cable 3 between the housing 2 and the internal cable conductor 22. The defeat latch 76 and/or compression spring 84 allow conductive separation between the connector and the conductor upon greater pulling forces (e.g., greater than 40 lbs/ft$^2$) that indicate someone or something is tampering with the locked security device 140 to possibly remove the security device from its attached article of merchandise.

When a pulling force applied to the internal cable conductor 22 causes the connector 25 to overcome the hold of the defeat latch 76 and to separate from connection with the conductor 26, the end wall 19 stops and holds the connector 25 in the second locking position, in a manner substantially similar to the ferrule 39 and recovery latch 78 shown in FIG. 5. The second locking position is not an electrically connectable position as the connector 25 is spatially separate from the conductor 26. Therefore the movement of the connector 25 from the first locking position to the second locking position opens the sense loop or electrical circuit, causing the security device 140 to alarm, which in all embodiments is preferably audible but is not limited thereto. However, during this defeat prevention alarm, the security device 140 remains locked and attached to its article of merchandise. Accordingly, the locked security device detects tampering and alarms if pulled too hard from twisting or pulling the cable without releasing the primary lock when the defeat latch fails. Any attempt to defeat the recovery latch and remove the security device 140 from its article of manufacture thus occurs while the security device is alarming.

The exemplary embodiment shown in FIG. 13 with the ferrule holder 142 of the defeat mechanism located in the compartment 60 of the housing 2 at the proximal end of the cable 3 provides numerous benefits. For example, when the half-body member 7 is separated from the half-body member 5 to open the housing 2, the cable is removable from the ferrule holder 142 of the housing by pulling or shifting the connector 25 up out of the compartment 60 because the connector 25 is not permanently fixed in the ferrule holder 142. This means that the entire cable assembly, including the locking plug 27 and connectors 25, 39 is easily removable from the housing 2 for replacement by another cable assembly as desired. This provides the benefit of using the invention with cable assemblies having cables of different length for added flexibility of securing the security device to articles of manufacture having various sizes and locking arrangements. As another benefit, the defeat mechanism of the preferred embodiments can be placed in the housing of different types of security devices (e.g., cable locks, spider locks, clamp tags) and thus broadly applied to alarming versions of security devices having cable ferrule mounts adaptable to include the connectors and ferrule holders discussed by example herein.

In yet another embodiment, a doubled-over thin wire looped thru the bayonet and back around to the main body of the cable lock housing is used in place of the above disclosed single fat cable with a ferrule on the end and an electrical termination. In this embodiment, the doubled-over thin wire terminates electrically by a contact between the spring contact and the crimped-on ferrule, similar to the spring contact and crimped on connector 25 described above in relation to the example depicted in FIG. 13. Of course the inventors appreciate that this thin wire embodiment could add a 2nd electromechanical switch to accomplish a similar objective.

Figure 14:
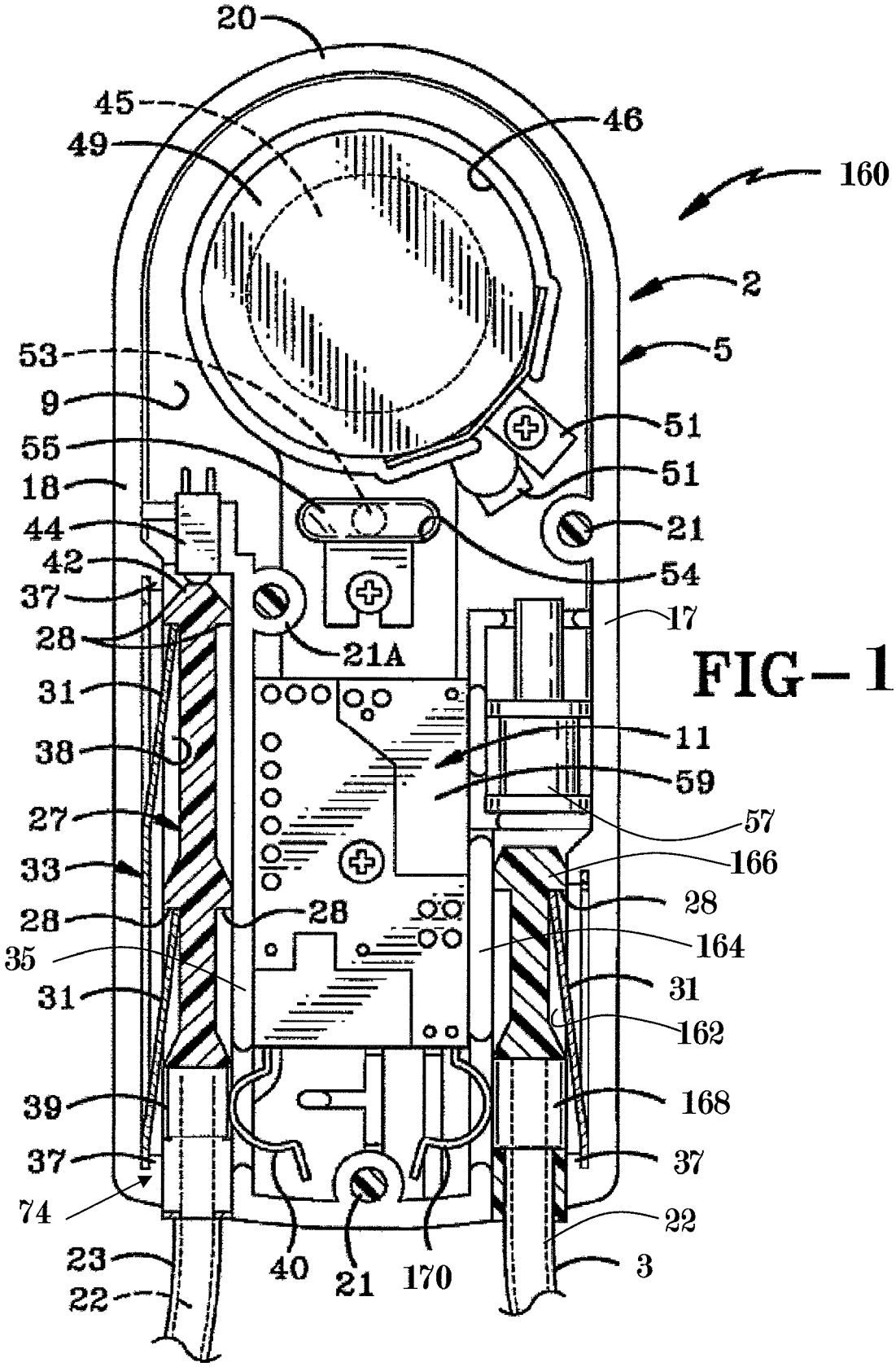
FIG. 14 is a plan view of the housing of the security device containing the alarm system components therein with the bayonet plug in a first locked position in accordance with yet still another example of the invention.

FIG. 14 depicts an exemplary security device 160 substantially similar to security devices 1, 100, 120 and 140 discussed above. In addition, the security device 160 includes a housing 2 having a second locking mechanism (e.g., a locking channel 162) formed between the edge wall 17 and a rib 164. The second locking channel 162 is preferably similar to the locking channel 38, but may be shorter in length or otherwise configured to lockingly receive a second locking plug 166, as readily understood by a skilled artisan. For example, the second locking plug 166 is secured to the proximal end of the cable 3. The locking plug 166 preferably is formed of a dielectric plastic material and has at least one locking shoulder 28 formed thereon, which when in a locked position engage a spring biased metal tine 31. The second locking plug 166 includes a common ferrule holder 168 that holds a connector 25 fixedly attached to the second locking plug. The connector 25 is crimped to the proximal end of the internal cable conductor 22 and is conductively coupled to the internal alarming system 11 via a spring metal clip 170, which is electrically connected to the internal alarm system.

While not being limited to a particular theory, the second locking plug 166 may also include a ferrule holder 74. It is understood that at least one of the locking plugs does include a ferrule holder, and that the invention is not limited to either side of the cable 3. This example of locking plugs at opposite ends of the cable makes the entire cable assembly, including the locking plugs easily removable when unlocked from the housing 2 for replacement by another cable assembly as desired. This provides the benefit of using the invention with cable assemblies having cables of different length for added flexibility of securing the security device to articles of manufacture having various sizes and locking arrangements.

In the foregoing description, certain terms have been used for brevity, clearness, and understanding. No unnecessary limitations are to be implied there from beyond the requirement of the prior art because such terms are used for descriptive purposes and are intended to be broadly construed.

It is understood that the self-alignment bayonet cable-lock closure described and shown are exemplary indications of preferred embodiments of the invention, and are given by way of illustration only. In other words, the concept of the present invention may be readily applied to a variety of preferred embodiments, including those disclosed herein. For example, the 2 stage tamper alarm could be broadly applied to alarming versions of Cable Locks, Keepers, O-tags, clamp tags, golf-shaft tags and likely Spider as well. In addition, a similar concept for an o-tag which would open and alarm if tampered with, but not release from the baseball bat or golf club. Further embodiments include a keeper having a lid that lifts partially up when someone tries to break it open, and starts to alarm, but a second mechanical engagement keeps it from being opened fully. The inventors also consider that a spider could have cable ferrule mounts substantially similar to the cable lock at the attachment to the spool. As still another example, a mechanical "fuse" could be added to the cable inside the spider's medallion to show an additional embodiment. While the invention has been described in detail and with reference to specific examples thereof, it will be apparent to one skilled in the art that various changes and modifications can be made therein without departing from the spirit and scope thereof. Without further elaboration, the foregoing will so fully illustrate the invention that others may, by applying current or future knowledge; readily adapt the same for use under various conditions of service.

What is claimed is:

1. A security device for attachment to an article to deter theft of the article, comprising a housing containing an alarm system including an audible alarm and a defeat prevention mechanism having a connector assembly that attaches to both an article holding member and the housing, the connector assembly including a mechanical fuse that maintains the attachment to the article holding member and the housing while causing the alarm system to initiate an alarm when the article holding member is forced away from said housing to provide defeat prevention of the security device;

said mechanical fuse including a ferrule holder having a first part spatially separate from a second part, said article holding member including a cable attached to a ferrule releasably held in the first part of the ferrule holder, said ferrule forcibly movable to the second part of the ferrule holder, said ferrule holder maintaining attachment to said cable, wherein when said security device is locked, a movement of said ferrule to the second part causes the alarm system to initiate the alarm while maintaining the lock of the security device.

2. The security device of claim 1, said connector assembly includes a generally elliptic cylindrical bayonet with an oval transverse cross-section and a truncated oblique cone-shaped distal end for automatic alignment of the bayonet into a channel of the housing in either of two directions.

3. A security device for attachment to an article to deter theft of the article, comprising:

a housing;

an alarm system including an alarm detection circuit;

an article holding member including a conductive mechanical connector mechanically attached to the housing and conductively coupled to the alarm detection circuit to form a sense loop; and a defeat prevention mechanism having a connector assembly attached to both the article holding member and the housing, the connector assembly including a mechanical fuse that maintains the mechanical attachment between the article holding member and the housing while causing the alarm detection circuit to initiate an alarm when the conductive mechanical connector opens the sense loop while being urged away from said housing to provide defeat prevention of the security device;

said connector assembly including a two-part ferrule holder having a first part spatially separate from a second part, said article holding member including a ferrule attached to the conductive mechanical connector, the ferrule releasably held in the first part of the ferrule holder, said ferrule forcibly movable to the second part of the two-part ferrule holder, said ferrule holder maintaining attachment to the conductive mechanical connector, wherein when said security device is locked, a movement of said ferrule to the second part opens the sense loop and causes the alarm system to initiate the alarm while maintaining the lock of the security device.

4. The security device of claim 3, the conductive mechanical connector including a cable having first and second ends, both ends being mechanically and conductively coupled to a respective ferrule, one of the respective ferrules being mechanically attached to the housing and conductively coupled to the alarm detection circuit, the other one of the respective ferrules being mechanically attached to the mechanical fuse and conductively coupled to the alarm detection circuit to form the sense loop.

5. The security device of claim 3, the housing including a locking mechanism that mechanically attaches the conductive mechanical connector to the housing, the article holding member further including a locking member aligned and locked to the locking mechanism of the housing, the locking member being directly attached to the mechanical fuse.

6. The security device of claim 3, the article holding member further including a locking member aligned and locked into a channel of the housing, the locking member being attached to the one of the respective ferrules for mechanically attaching the ferrule to the housing.

7. The security device of claim 3, the housing having a compartment containing the connector assembly.

8. The security device of claim 4, said cable including a first cable conductor conductively coupled to the respective ferrules for forming the sense loop, said cable further including a second cable conductor conductively coupled to the sense loop to form an additional conductive loop, the additional conductive loop maintaining the sense loop in a closed condition when the first cable conductor is spliced.

9. The security device of claim 3, the conductive mechanical connector having a proximal end and a distal end, the article holding member including a locking member at the distal end locked into a channel of the housing, and a ferrule at the proximal end mechanically coupled to the housing.

10. The security device of claim 9, the ferrule at the proximal end being slidably removable from its mechanical coupling to the housing and from its conductive coupling with the alarm detection circuit.

11. The security device of claim 3, the housing including a first locking mechanism and a second locking mechanism that mechanically attaches the conductive mechanical connector to the housing, the conductive mechanical connector having a proximal end and a distal end, the article holding member including a first locking member at the distal end locked into the first locking mechanism of the housing, and a second locking member at the proximal end mechanically locked into the second locking mechanism of the housing, both the first locking member and the second locking member being slidably removable from their respective locking mechanism when the security device is unlocked.

12. A security device for attachment to an article to deter theft of the article, comprising:

a housing having a first locking mechanism and a second locking mechanism;

an alarm system including an alarm detection circuit; and an article holding member extending from the housing for attachment to the article, said article holding member including a conductive mechanical connector mechanically attached to the housing and conductively coupled to the alarm detection circuit to form a sense loop that when severed actuates the alarm system, the conductive mechanical connector having a proximal end and a distal end, the article holding member including a first locking member at the distal end locked into the first locking mechanism of the housing, and a second locking member at the proximal end mechanically locked into the second locking mechanism of the housing, both the first locking member and the second locking member being slidably removable from their respective locking mechanism when the security device is unlocked to remove the article holding member from the housing.

13. The security device of claim 12, further comprising a mechanical fuse that maintains the mechanical attachment between the article holding member and the housing while causing the alarm detection circuit to initiate an alarm when the conductive mechanical connector opens the sense loop while being urged away from said housing to provide defeat prevention of the security device.

* * * * *